US010618139B2

(12) United States Patent
Sun

(10) Patent No.: US 10,618,139 B2
(45) Date of Patent: Apr. 14, 2020

(54) EXPANDABLE HANDHELD PNEUMATIC BELT GRINDER

(71) Applicant: STORM PNEUMATIC TOOL CO., LTD., Taichung (TW)

(72) Inventor: Yung Yung Sun, Taichung (TW)

(73) Assignee: Storm Pneumatic Tool Co., Ltd., Taichung (TW)

( * ) Notice: Subject to any disclaimer, the term of this patent is extended or adjusted under 35 U.S.C. 154(b) by 300 days.

(21) Appl. No.: 15/906,367

(22) Filed: Feb. 27, 2018

(65) Prior Publication Data

US 2018/0290259 A1 Oct. 11, 2018

(30) Foreign Application Priority Data

Apr. 10, 2017 (TW) ..... 106204896 U

(51) Int. Cl.

| | |
|---|---|
| ***B24B 23/06*** | (2006.01) |
| ***B24B 21/20*** | (2006.01) |
| ***B24B 21/00*** | (2006.01) |
| ***B24B 47/14*** | (2006.01) |
| ***B24B 21/18*** | (2006.01) |

(52) U.S. Cl.

CPC ..... *B24B 23/06* (2013.01); *B24B 21/00* (2013.01); *B24B 21/18* (2013.01); *B24B 21/20* (2013.01); *B24B 47/14* (2013.01)

(58) Field of Classification Search

CPC ..... B24B 21/00; B24B 21/18; B24B 21/20; B24B 23/06

USPC ..... 451/355

See application file for complete search history.

(56) References Cited

U.S. PATENT DOCUMENTS

| | | | | | |
|---|---|---|---|---|---|
| 2,486,255 | A | * | 10/1949 | Briskin | B24B 23/06 451/355 |
| 3,427,757 | A | * | 2/1969 | Redman | B24B 23/06 451/355 |
| 3,619,949 | A | * | 11/1971 | Welsch et al. | B24B 23/06 451/355 |
| 3,713,255 | A | * | 1/1973 | Welsch | B24B 23/06 451/355 |
| 4,368,597 | A | * | 1/1983 | Fleckenstein | B24B 23/06 451/311 |
| 4,392,333 | A | * | 7/1983 | Welsch | B24B 23/06 451/355 |

(Continued)

*Primary Examiner* — Eileen P Morgan

(74) *Attorney, Agent, or Firm* — Thomas J. Nikolai; DeWitt LLP

(57) ABSTRACT

An expandable handheld pneumatic belt grinder includes a body, an expansion component and an operation component. The body has a receiving space, a pneumatic motor, and a rotating wheel driven by the pneumatic motor. The expansion component has an expansion pipe and an expansion rod which are connected. The expansion rod is coupled to the receiving space. The operation component has a support rod with one end carrying a driven wheel and the other end coupled to the receiving space or expansion pipe. A grinding belt fits around the driven wheel and rotating wheel collectively. A user changes the distance between the rotating wheel and driven wheel by choosing between two options: coupling the support rod of operation component and the receiving space; and coupling the expansion rod of expansion component and the receiving space, and then coupling the support rod of operation component and the expansion pipe.

4 Claims, 7 Drawing Sheets

(56) References Cited

U.S. PATENT DOCUMENTS

| | | | | | |
|---|---|---|---|---|---|
| 4,578,906 | A * | 4/1986 | Appleton | B24B 23/06 | 451/355 |
| 4,858,390 | A * | 8/1989 | Kenig | B24B 23/06 | 451/296 |
| 5,031,362 | A * | 7/1991 | Reiling | B24B 23/06 | 451/355 |
| 5,210,981 | A * | 5/1993 | Urda | B24B 23/06 | 451/296 |
| 6,174,226 | B1 * | 1/2001 | Frech | B24B 21/20 | 451/303 |
| 6,503,128 | B1 * | 1/2003 | Deware | B24B 23/06 | 451/297 |
| 9,511,468 | B2 * | 12/2016 | Suzuki | B24B 21/20 | |
| 10,427,270 | B2 * | 10/2019 | Johnson | B24B 41/04 | |
| 2019/0262965 | A1 * | 8/2019 | Geiger | B24B 21/00 | |

* cited by examiner

EXPANDABLE HANDHELD PNEUMATIC BELT GRINDER

BACKGROUND OF THE INVENTION

1. Technical Field

The present invention relates to pneumatic belt grinders and, more particularly, to an expandable handheld pneumatic belt grinder.

2. Description of Related Art

FIG. 7 shows a conventional pneumatic belt grinder which includes a rear-positioned pneumatic motor 71, a front-positioned driven wheel 72, and a grinding belt 73 winding around the pneumatic motor 71 and the driven wheel 72 collectively. The pneumatic motor 71 and the driven wheel 72 are connected by a support rod 74 and spaced apart by a distance; hence, the grinding belt 73 is stretched rearward and forward and thus tightened. Therefore, the grinding belt 73 is driven by the pneumatic motor 71 to run, thereby grinding a workpiece.

Commercially-available grinding belts come in different specifications, for example, lengths. However, the support rod 74 of the conventional pneumatic belt grinder is of a fixed length. Owing to its invariable length, the support rod 74 is only applicable to the grinding belt 73 with a corresponding specification, thereby being limited in its application.

BRIEF SUMMARY OF THE INVENTION

It is an objective of the present invention to provide an expandable handheld pneumatic belt grinder with a support rod connected to an expansion component to therefore render its total length extensible, thereby suiting the support rod to long grinding belts.

In order to achieve the above and other objectives, the present invention provides an expandable handheld pneumatic belt grinder, comprising:

a body having a pneumatic motor and a receiving space, with the pneumatic motor connected to a rotating wheel;

an expansion component having an expansion pipe and an expansion rod, the expansion pipe having two ends which a first coupling portion and a second coupling portion are disposed at respectively, the expansion rod having two ends which a first connecting portion and a second connecting portion are disposed at respectively, wherein the first connecting portion of the expansion rod is inserted into the expansion pipe and fixed to the first coupling portion, and the second connecting portion of the expansion rod is able to be coupled to the receiving space; and an operation component comprising a support rod, the support rod having an end which a driven wheel is disposed at and another end which a third connecting portion is disposed at, wherein the third connecting portion is able to be coupled to the receiving space and the second coupling portion of the expansion pipe, and a grinding belt fits around the driven wheel and the rotating wheel collectively;

wherein a user changes a distance between the rotating wheel and the driven wheel by choosing between two options: (1) coupling the third connecting portion of the support rod of the operation component and the receiving space; and (2) coupling the second connecting portion of the expansion rod of the expansion component and the receiving space, and then coupling the third connecting portion of the support rod of the operation component and the second coupling portion of the expansion pipe.

In an embodiment, a first spring is disposed in the receiving space and adapted to resiliently press against the support rod or the expansion rod insertedly disposed in the receiving space.

In an embodiment, pin holes are disposed at the receiving space, the first connecting portion and the second connecting portion of the expansion rod, the first coupling portion and the second coupling portion of the expansion pipe, and the third connecting portion of the support rod, respectively, allowing alignment of the pin hole of the first connecting portion and the pin hole of the first coupling portion and subsequent penetration of a pin into the two pin holes so as to couple the first connecting portion and the first coupling portion together, allowing alignment of the pin hole of the second connecting portion and the pin hole of the receiving space and subsequent penetration of a pin into the two pin holes so as to couple the second connecting portion and the receiving space together, and allowing alignment of the pin hole of the third connecting portion and the pin hole of one of the second coupling portion and the receiving space and subsequent penetration of a pin into the two pin holes so as to couple the third connecting portion and one of the second coupling portion and the receiving space together.

A positioning element is pivotally disposed at the body, has an end which a positioning hook portion is disposed at and inserted into the pin hole of the receiving space, and has another end which a second spring received in a receiving hole of the body presses against resiliently, wherein the positioning hook portion is engaged with the pin insertedly disposed at the second connecting portion such that the expansion rod is positioned in the receiving space or engaged with the pin insertedly disposed at the third connecting portion, thereby positioning the support rod in the receiving space.

DETAILED DESCRIPTION OF THE INVENTION

Figure 1:
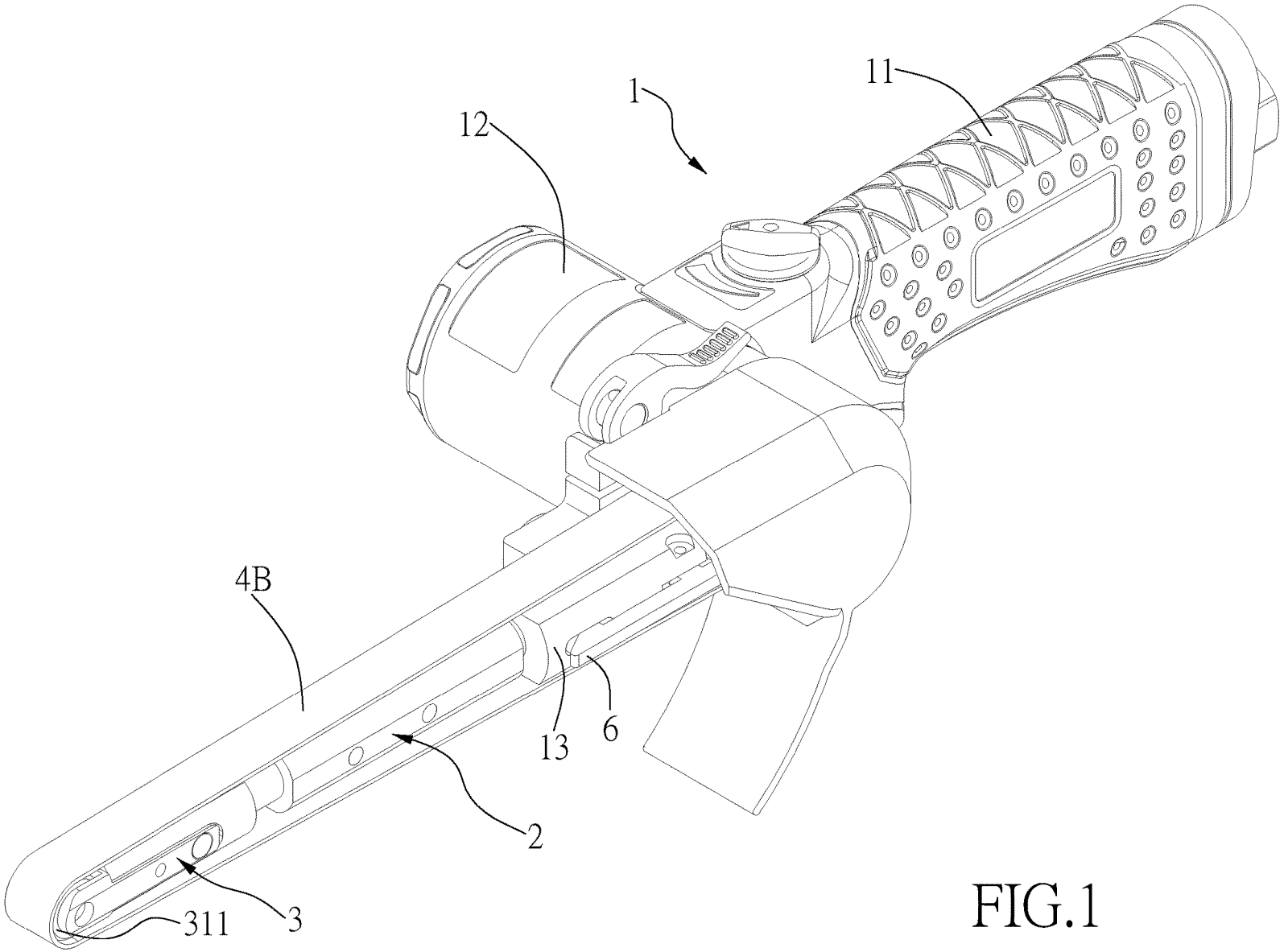
FIG. 1 is a perspective view of an expandable handheld pneumatic belt grinder according to the first embodiment of the present invention.
Figure 2:
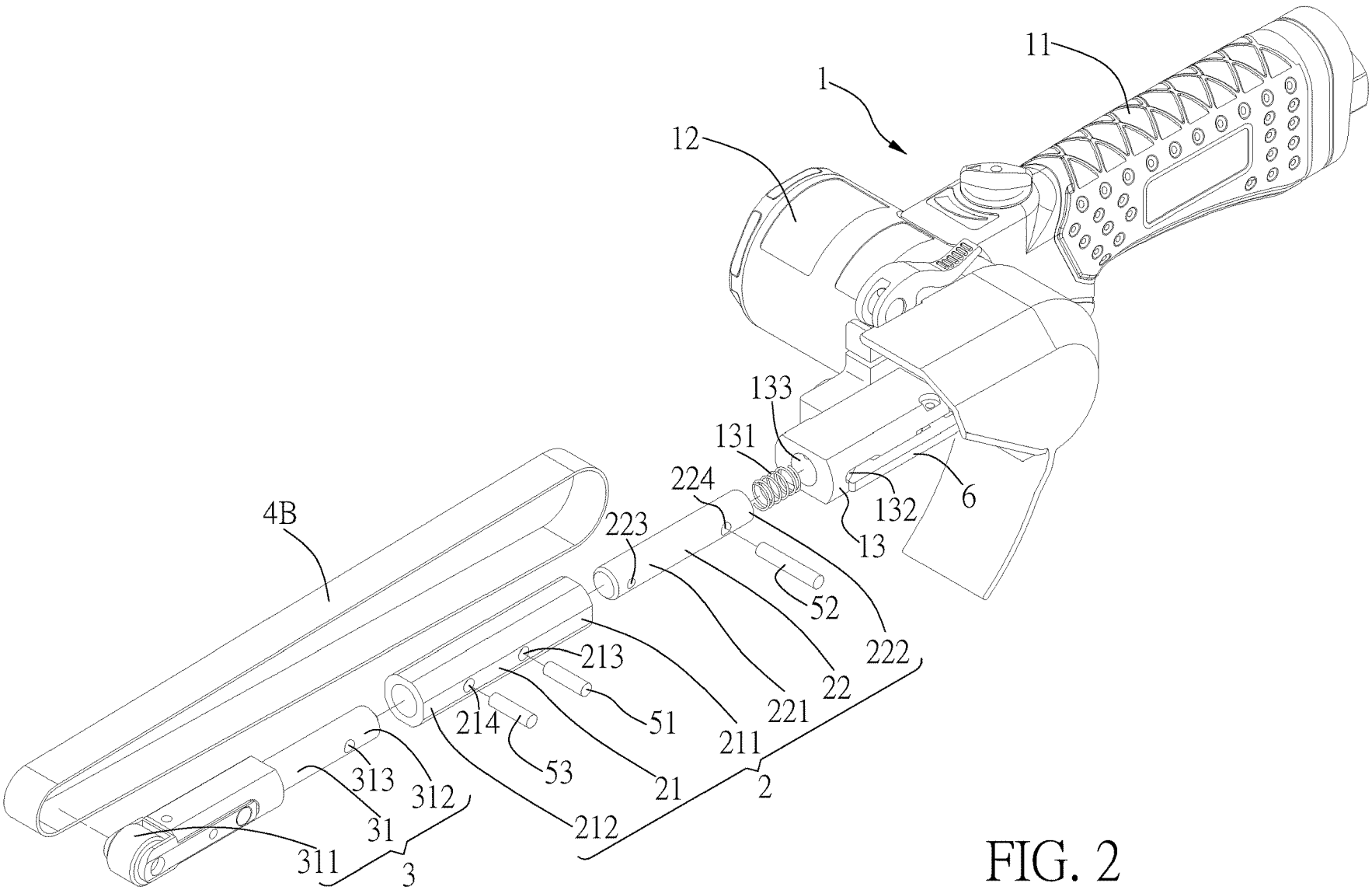
FIG. 2 is an exploded view of the expandable handheld pneumatic belt grinder according to the first embodiment of the present invention.

Referring to FIGS. 1, 2, there are shown an expandable handheld pneumatic belt grinder provided by the present invention. The expandable handheld pneumatic belt grinder comprises a body 1, an expansion component 2 and an operation component 3. The body 1 has a handle 11 to be held by hand. A pneumatic motor 12 is disposed in front of the handle 11. The pneumatic motor 12 connects with a rotating wheel (not shown) and drives the rotating wheel to rotate. The body 1 further has a connector 13 disposed in front of the handle 11. The connector 13 has therein a receiving space 133. A first spring 131 is disposed in the receiving space 133.

The expansion component 2 comprises an expansion pipe 21 and an expansion rod 22. The expansion pipe 21, which is hollow-core, straight and pipelike, has two ends defined as a first coupling portion 211 and a second coupling portion 212, respectively. The expansion rod 22, which is a straight rod, has two ends defined as a first connecting portion 221 and a second connecting portion 222, respectively. The first connecting portion 221 of the expansion rod 22 is inserted into the expansion pipe 21 and fixed to the first coupling portion 211. The second connecting portion 222 of the expansion rod 22 is able to be coupled to the receiving space 133.

The operation component 3 comprises a support rod 31. The support rod 31 has one end which a driven wheel 311 is pivotally disposed at and the other end which a third connecting portion 312 is disposed at. The third connecting portion 312 of the support rod 31 corresponds in position to the receiving space 133 and is able to be coupled thereto. Alternatively, the third connecting portion 312 of the support rod 31 corresponds in position to the second coupling portion 212 of the expansion pipe 21 and is able to be coupled thereto.

Given the aforesaid structure, the expandable handheld pneumatic belt grinder of the present invention may be assembled in two different ways described below. First, referring to FIGS. 4, 5, the third connecting portion 312 of the support rod 31 of the operation component 3 is directly coupled to the receiving space 133 and thus resiliently abutted against the first spring 131 to therefore dispense with the expansion component 2 and attain a short distance between the driven wheel 311 and the rotating wheel 121, thereby allowing a short grinding belt 4A to be disposed between the driven wheel 311 and the rotating wheel 121. Second, referring to FIGS. 1, 3, the second connecting portion 222 of the expansion rod 22 of the expansion component 2 is coupled to the receiving space 133 and thus resiliently abutted against the first spring 131, and then the third connecting portion 312 of the support rod 31 of the operation component 3 is coupled to the second coupling portion 212 of the expansion pipe 21, so as to attain a long distance between the driven wheel 311 and the rotating wheel 121, thereby allowing a long grinding belt 4B to be disposed between the driven wheel 311 and the rotating wheel 121. As revealed above, the length of the grinding belt is useful in determining whether the expansion component 3 is required. Therefore, the expandable handheld pneumatic belt grinder of the present invention has wide application.

Figure 3:
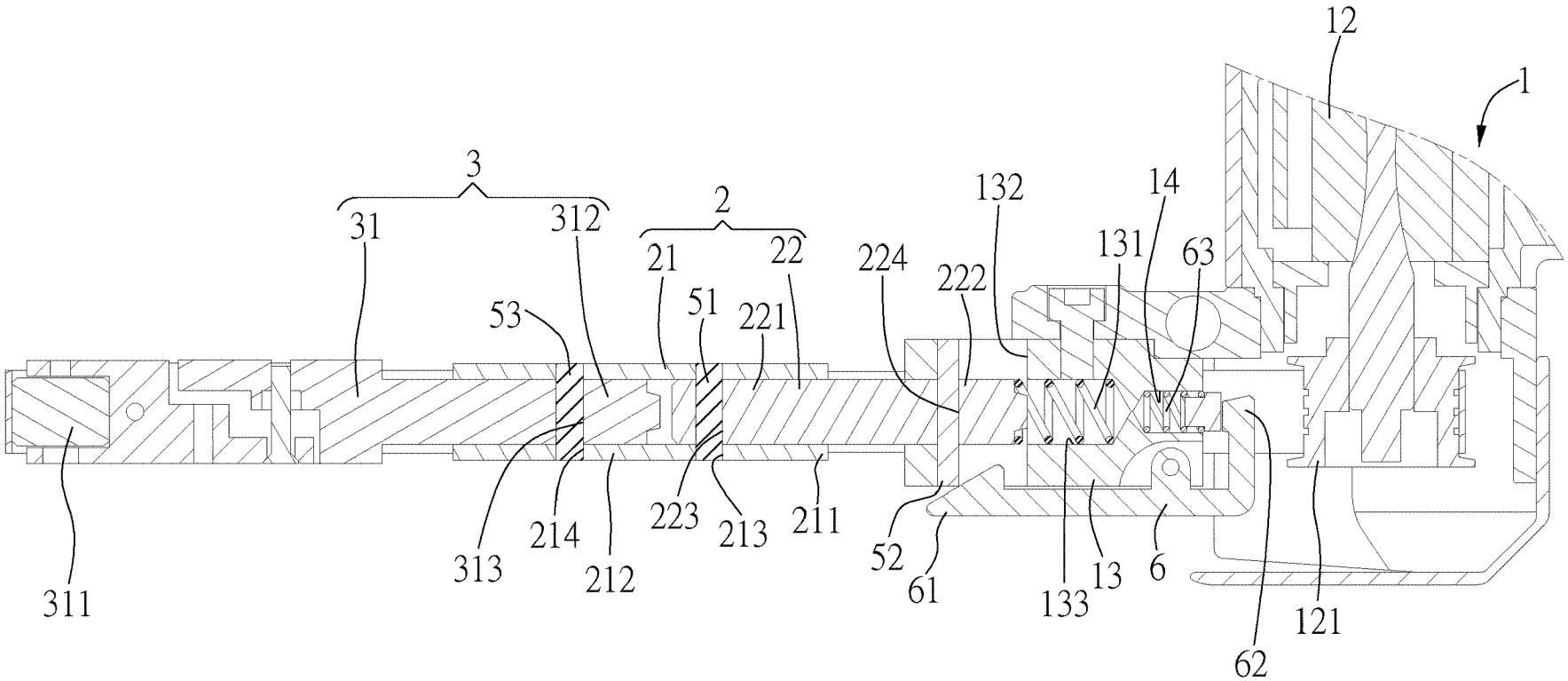
FIG. 3 is a partial cross-sectional view of the expandable handheld pneumatic belt grinder according to the first embodiment of the present invention.
Figure 4:
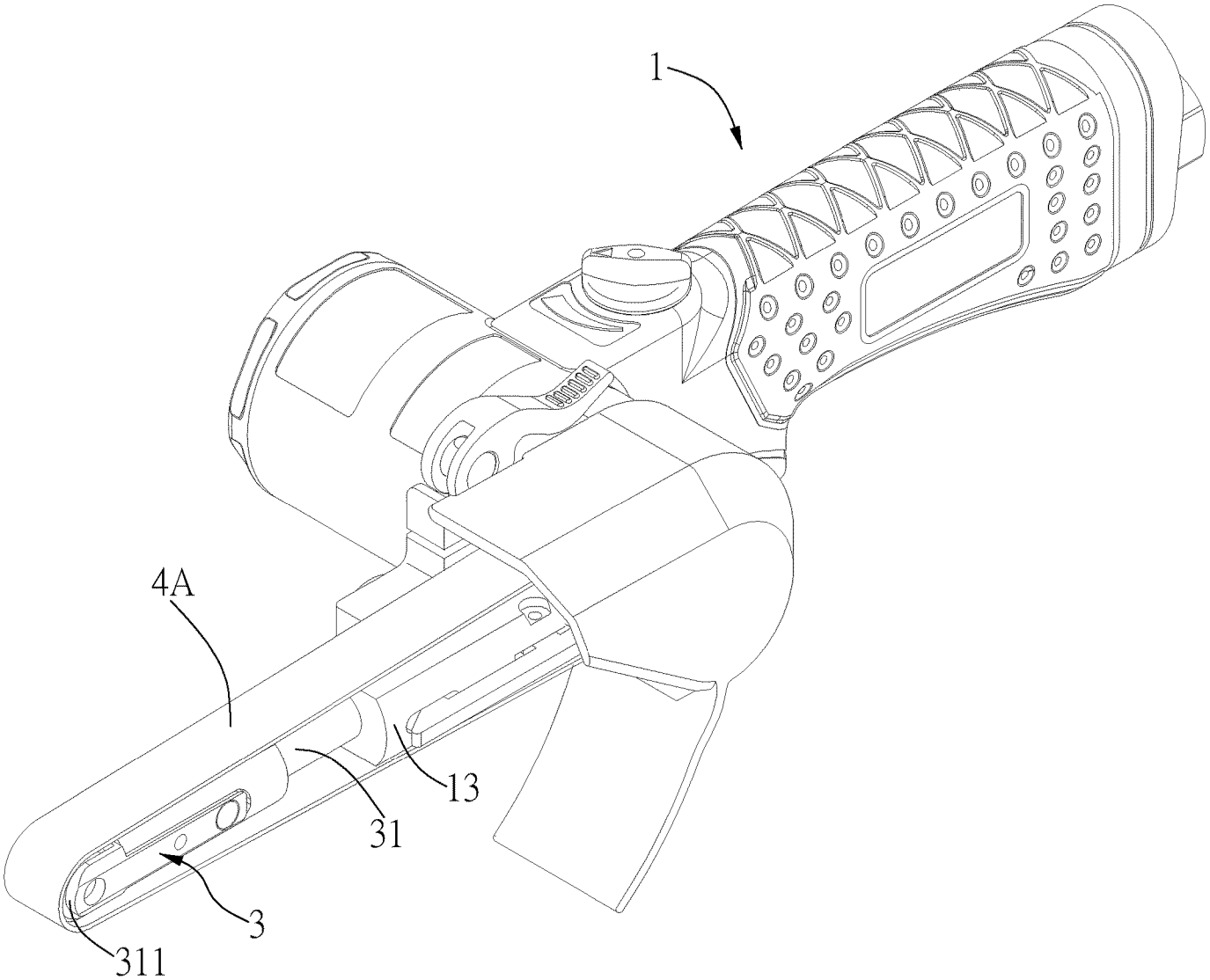
FIG. 4 is a perspective view of the expandable handheld pneumatic belt grinder according to the second embodiment of the present invention.
Figure 5:
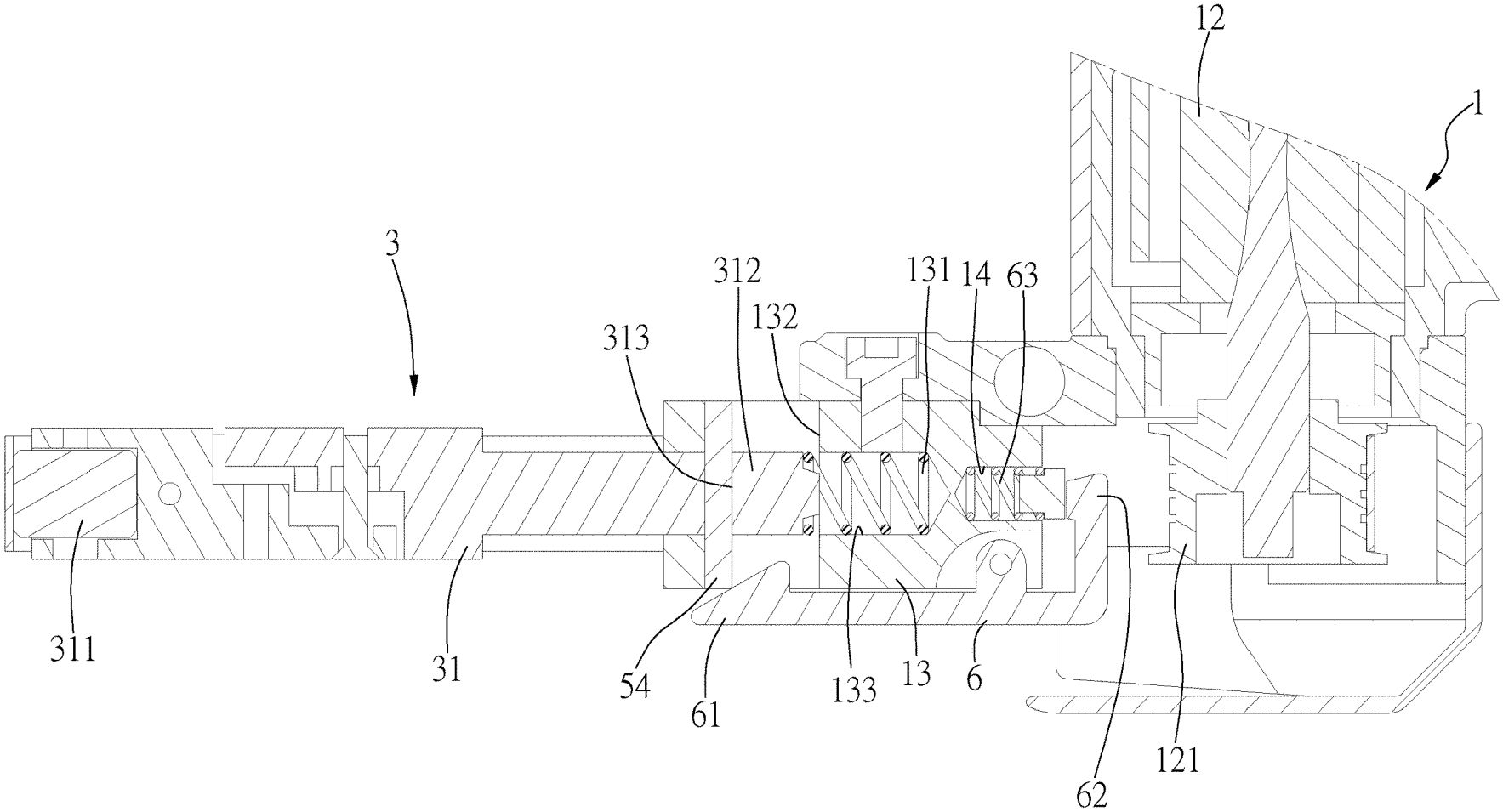
FIG. 5 is a partial cross-sectional view of the expandable handheld pneumatic belt grinder according to the second embodiment of the present invention.

In this embodiment, constituent elements of the expandable handheld pneumatic belt grinder are fixed together by insertion of pins into pin holes. Referring to FIG. 2, pin holes 132, 223, 224, 213, 214, 313 are disposed at the receiving space 133, the first connecting portion 221 and the second connecting portion 222 of the expansion rod 22, the first coupling portion 211 and the second coupling portion 212 of the expansion pipe 21, and the third connecting portion 312 of the support rod 31, respectively. Referring to FIG. 3, the pin holes 223, 213 of the first connecting portion 221 and the first coupling portion 211 are aligned and then penetrated by a pin 51 to couple the expansion rod 22 and the expansion pipe 21 together, the pin holes 224, 132 of the second connecting portion 222 and the receiving space 133 are aligned and then penetrated by a pin 52 to couple the expansion rod 22 and the receiving space 133 together, and the pin holes 313, 214 of the third connecting portion 312 and the second coupling portion 212 are aligned and then penetrated by a pin 53 to couple the support rod 31 and the expansion pipe 21 together. Referring to FIG. 5, the pin holes 313, 132 of the third connecting portion 312 and the receiving space 133 are aligned and then penetrated by a pin 54 to couple the support rod 31 and the receiving space 133 together.

Figure 6:
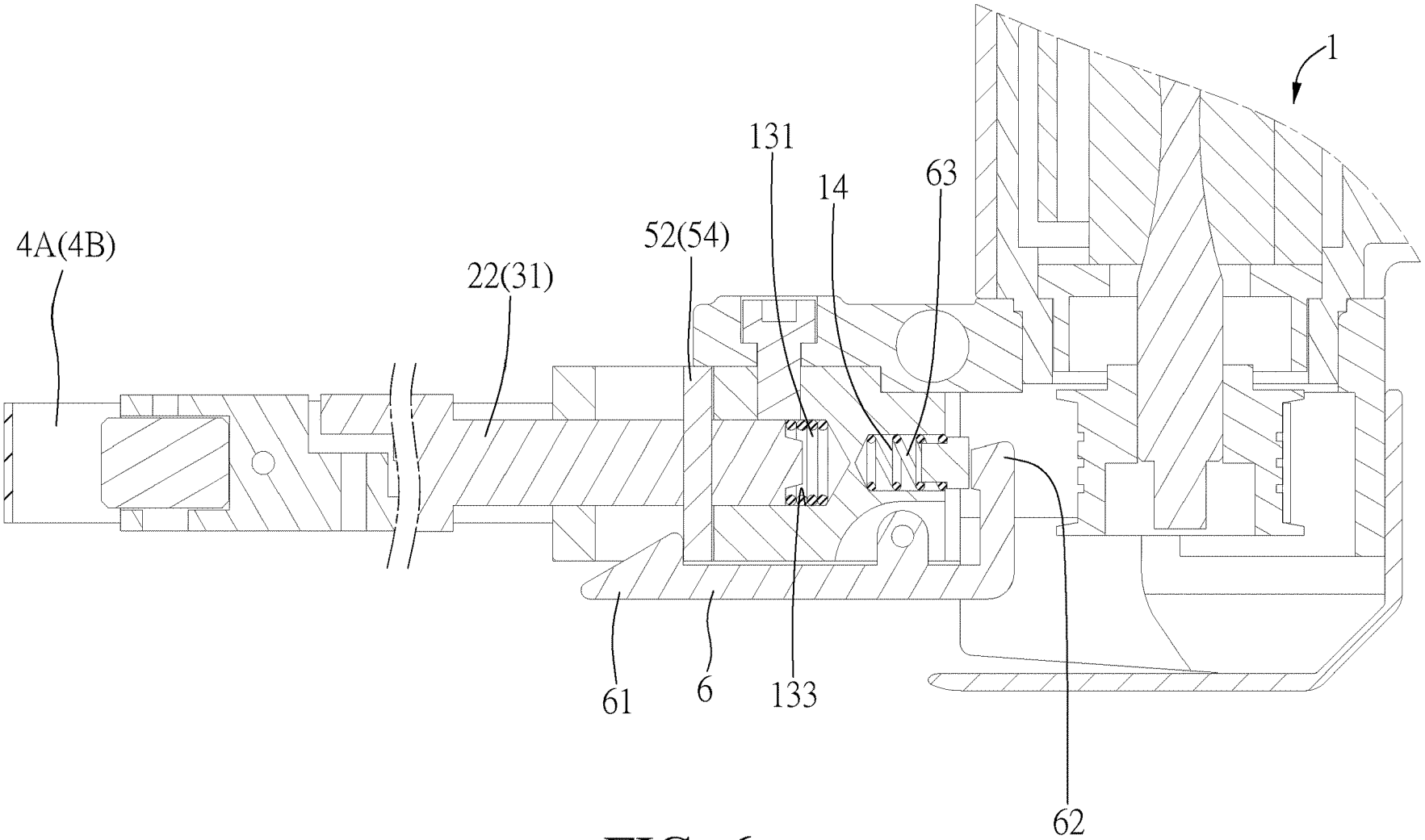
FIG. 6 is a cross-sectional view of the expandable handheld pneumatic belt grinder of the present invention, showing how to change a grinding belt.
Figure 7:
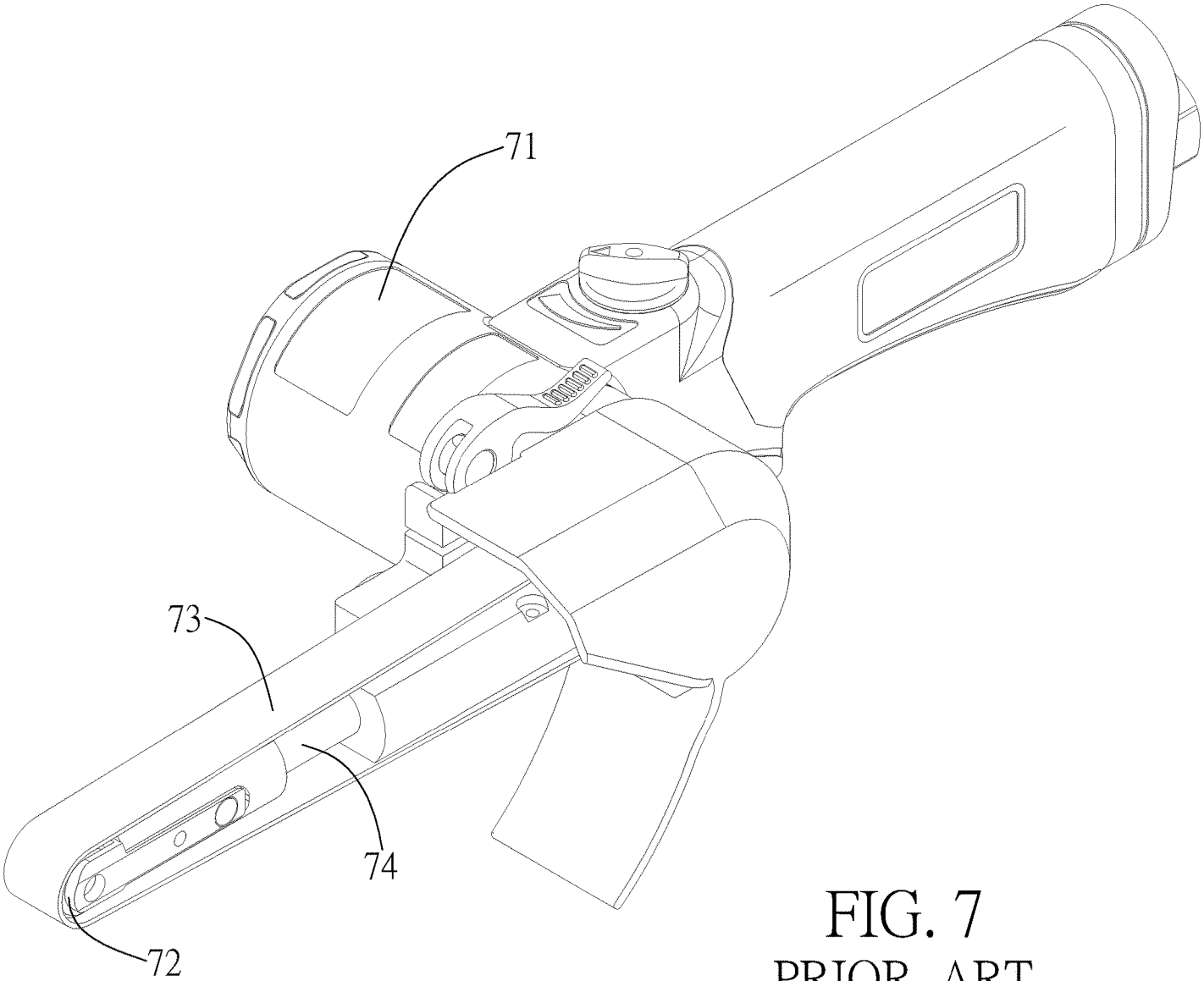
FIG. 7 PRIOR ART
FIG. 7 (PRIOR ART) is a perspective view of a conventional pneumatic belt grinder.

Referring to FIGS. 3, 5, in this embodiment, a positioning element 6 is pivotally disposed at the body 1. The positioning element 6 has one end which a positioning hook portion 61 is disposed at and the other end which a press block 62 is disposed at. A second spring 63 is received in a receiving hole 14 of the body 1 and adapted to press against the press block 62 resiliently such that the positioning hook portion 61 is inserted into the pin hole 132 of the receiving space 133. Referring to FIG. 6, to change the grinding belt 4A or 4B, a user pushes the expansion rod 22 or the support rod 31 into the receiving space 133 and thereby compresses the first spring 131 such that the positioning hook portion 61 becomes engaged with the expansion rod 22 or the support rod 31 and positioned in place, thereby allowing the grinding belt 4A or 4B to be loosened and changed.

What is claimed is:

1. An expandable handheld pneumatic belt grinder, comprising:

a body having a pneumatic motor and a receiving space, with the pneumatic motor connected to a rotating wheel;

an expansion component having an expansion pipe and an expansion rod, the expansion pipe having two ends which a first coupling portion and a second coupling portion are disposed at respectively, the expansion rod having two ends which a first connecting portion and a second connecting portion are disposed at respectively, wherein the first connecting portion of the expansion rod is inserted into the expansion pipe and fixed to the first coupling portion, and the second connecting portion of the expansion rod is able to be coupled to the receiving space; and an operation component comprising a support rod, the support rod having an end which a driven wheel is disposed at and another end which a third connecting portion is disposed at, wherein the third connecting portion is able to be coupled to the receiving space, the third connecting portion is able to be coupled to the second coupling portion of the expansion pipe, and a grinding belt fits around the driven wheel and the rotating wheel collectively;

wherein a distance between the rotating wheel and the driven wheel changes from a first assembly state that coupling the third connecting portion of the support rod of the operation component and the receiving space to a second assembly state that coupling the second connecting portion of the expansion rod of the expansion component and the receiving space, and then coupling the third connecting portion of the support rod of the operation component and the second coupling portion of the expansion pipe.

2. The expandable handheld pneumatic belt grinder of claim 1, wherein a first spring is disposed in the receiving space and adapted to resiliently press against one of the support rod and the expansion rod insertedly disposed in the receiving space.

3. The expandable handheld pneumatic belt grinder of claim 1, wherein pin holes are disposed at the receiving space, the first connecting portion and the second connecting portion of the expansion rod, the first coupling portion and the second coupling portion of the expansion pipe, and the third connecting portion of the support rod, respectively, allowing alignment of the pin hole of the first connecting portion and the pin hole of the first coupling portion and subsequent penetration of a pin into the two pin holes so as to couple the first connecting portion and the first coupling portion together, allowing alignment of the pin hole of the second connecting portion and the pin hole of the receiving space and subsequent penetration of a pin into the two pin holes so as to couple the second connecting portion and the receiving space together, and allowing alignment of the pin hole of the third connecting portion and the pin hole of one of the second coupling portion and the receiving space and subsequent penetration of a pin into the two pin holes so as to couple the third connecting portion and one of the second coupling portion and the receiving space together.

4. The expandable handheld pneumatic belt grinder of claim 3, wherein a positioning element is pivotally disposed at the body, has an end which a positioning hook portion is disposed at and inserted into the pin hole of the receiving space, and has another end which a second spring received in a receiving hole of the body presses against resiliently, wherein the positioning hook portion is engaged with the pin insertedly disposed at the second connecting portion such that the expansion rod is positioned in the receiving space or engaged with the pin insertedly disposed at the third connecting portion, thereby positioning the support rod in the receiving space.

* * * * *